US012168983B1

(12) United States Patent
Heeter et al.

(10) Patent No.: US 12,168,983 B1
(45) Date of Patent: Dec. 17, 2024

(54) ACTIVE FAN TIP TREATMENT USING ROTATING DRUM ARRAY IN FAN TRACK LINER WITH AXIAL AND CIRCUMFERENTIAL CHANNELS FOR DISTORTION TOLERANCE

(71) Applicants: Rolls-Royce North American Technologies Inc., Indianapolis, IN (US); Rolls-Royce Corporation, Indianapolis, IN (US)

(72) Inventors: Robert W. Heeter, Indianapolis, IN (US); Daniel E. Molnar, Jr., Indianapolis, IN (US); Jonathan M. Rivers, Indianapolis, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 18/759,050

(22) Filed: Jun. 28, 2024

(51) Int. Cl.

| | |
|---|---|
| ***F04D 29/68*** | (2006.01) |
| ***F01D 11/08*** | (2006.01) |
| ***F04D 27/02*** | (2006.01) |
| ***F04D 29/52*** | (2006.01) |
| *F01D 11/22* | (2006.01) |

(52) U.S. Cl.
CPC ..... *F04D 27/0215* (2013.01); *F01D 11/08* (2013.01); *F04D 29/526* (2013.01); *F04D 29/685* (2013.01); *F01D 11/22* (2013.01)

(58) Field of Classification Search
CPC ..... F04D 29/685; F04D 29/526; F01D 11/08; F01D 11/22
See application file for complete search history.

(56) References Cited

U.S. PATENT DOCUMENTS

| | | | |
|---|---|---|---|
| 4,086,022 | A | 4/1978 | Freeman et al. |
| 4,155,680 | A | 5/1979 | Linko, III et al. |
| 4,239,452 | A | 12/1980 | Roberts, Jr. |
| 5,137,419 | A | 8/1992 | Waterman |
| 5,308,225 | A | 5/1994 | Koff et al. |
| 5,474,417 | A | 12/1995 | Privett et al. |
| 5,762,470 | A | 6/1998 | Gelmedov et al. |
| 6,231,301 | B1 | 5/2001 | Barnett et al. |
| 6,406,470 | B1 | 6/2002 | Kierce |
| 6,497,551 | B1 | 12/2002 | Hand et al. |
| 6,514,039 | B1 | 2/2003 | Hand |
| 6,619,909 | B2 | 9/2003 | Barnett et al. |
| 6,648,591 | B2 | 11/2003 | Collins |
| 6,685,426 | B2 | 2/2004 | Clark |

(Continued)

FOREIGN PATENT DOCUMENTS

| | | | |
|---|---|---|---|
| CN | 201152282 | Y | 11/2008 |
| CN | 104373388 | B | 1/2017 |

(Continued)

*Primary Examiner* — Woody A Lee, Jr.
*Assistant Examiner* — Behnoush Haghighian
(74) *Attorney, Agent, or Firm* — Barnes & Thornburg LLP

(57) ABSTRACT

A gas turbine engine includes a fan and a fan case assembly. The fan includes a fan rotor configured to rotate about an axis of the gas turbine engine and a plurality of fan blades coupled to the fan rotor for rotation therewith. The fan case assembly extends circumferentially around the plurality of fan blades radially outward of the plurality of the fan blades.

20 Claims, 9 Drawing Sheets

(56) References Cited

U.S. PATENT DOCUMENTS

| | | | | |
|---|---|---|---|---|
| 6,736,594 | B2 * | 5/2004 | Irie | F04D 29/547 415/173.1 |
| 6,742,983 | B2 | 6/2004 | Schmuecker | |
| 6,832,890 | B2 | 12/2004 | Booth | |
| 6,905,305 | B2 | 6/2005 | James | |
| 6,935,833 | B2 | 8/2005 | Seitz | |
| 7,077,623 | B2 | 7/2006 | Guemmer | |
| 7,186,072 | B2 | 3/2007 | Seitz | |
| 7,210,905 | B2 | 5/2007 | Lapworth | |
| 7,575,412 | B2 | 8/2009 | Seitz | |
| 7,967,556 | B2 | 6/2011 | Volker | |
| 8,043,046 | B2 | 10/2011 | Guemmer | |
| 8,152,444 | B2 | 4/2012 | Guemmer | |
| 8,152,445 | B2 | 4/2012 | Guemmer | |
| 8,152,467 | B2 | 4/2012 | Guemmer | |
| 8,182,209 | B2 | 5/2012 | Brault et al. | |
| 8,192,148 | B2 | 6/2012 | Guemmer | |
| 8,257,022 | B2 | 9/2012 | Guemmer | |
| 8,262,340 | B2 | 9/2012 | Guemmer | |
| 8,337,146 | B2 | 12/2012 | Yu | |
| 8,403,630 | B2 | 3/2013 | Guemmer | |
| 8,419,355 | B2 | 4/2013 | Guemmer et al. | |
| 8,602,720 | B2 | 12/2013 | Goswami et al. | |
| 8,845,269 | B2 | 9/2014 | Agneray et al. | |
| 8,915,699 | B2 | 12/2014 | Brignole et al. | |
| 9,638,213 | B2 | 5/2017 | Obrecht et al. | |
| 9,651,060 | B2 | 5/2017 | Morel et al. | |
| 9,816,528 | B2 | 11/2017 | Johann | |
| 9,957,976 | B2 | 5/2018 | Allford | |
| 10,024,336 | B2 | 7/2018 | Obrecht et al. | |
| 10,047,620 | B2 | 8/2018 | Giacché et al. | |
| 10,066,640 | B2 | 9/2018 | Bennington et al. | |
| 10,378,550 | B2 * | 8/2019 | Lim | F04D 29/685 |
| 10,450,869 | B2 | 10/2019 | Brignole et al. | |
| 10,539,154 | B2 | 1/2020 | Mallina et al. | |
| 10,914,318 | B2 | 2/2021 | Capozzi et al. | |
| 11,078,805 | B2 | 8/2021 | Joly et al. | |
| 11,092,030 | B2 * | 8/2021 | Joly | F04D 29/685 |
| 11,131,322 | B2 | 9/2021 | Grothe et al. | |
| 11,473,438 | B2 | 10/2022 | Reynolds et al. | |
| 11,572,897 | B1 * | 2/2023 | Duong | F04D 27/0246 |
| 11,686,207 | B2 | 6/2023 | Brignole et al. | |
| 11,702,945 | B2 | 7/2023 | Heeter et al. | |
| 11,732,612 | B2 | 8/2023 | Molnar, Jr. et al. | |
| 2003/0002982 | A1 * | 1/2003 | Irie | F04D 15/0027 415/220 |
| 2005/0226717 | A1 | 10/2005 | Xu | |
| 2007/0147989 | A1 | 6/2007 | Collins | |
| 2008/0044273 | A1 | 2/2008 | Khalid | |
| 2009/0065064 | A1 | 3/2009 | Morris et al. | |
| 2010/0310353 | A1 | 12/2010 | Yu | |
| 2012/0269619 | A1 | 10/2012 | Johann | |
| 2012/0315131 | A1 * | 12/2012 | Mertens | F04D 27/0215 415/126 |
| 2014/0119883 | A1 | 5/2014 | Kempf | |
| 2015/0086344 | A1 | 3/2015 | Guemmer | |
| 2016/0010652 | A1 * | 1/2016 | Lim | F04D 27/002 415/128 |
| 2016/0230776 | A1 | 8/2016 | Bennington et al. | |
| 2018/0163562 | A1 | 6/2018 | Khare et al. | |
| 2020/0224675 | A1 | 7/2020 | Capozzi et al. | |
| 2020/0332673 | A1 * | 10/2020 | Joly | F01D 9/047 |

FOREIGN PATENT DOCUMENTS

| | | | |
|---|---|---|---|
| CN | 110242616 | A | 9/2019 |
| CN | 113217469 | A | 8/2021 |
| DE | 60201109 | T2 | 10/2004 |
| DE | 102007056953 | A1 | 5/2009 |
| DE | 102011007767 | A1 | 10/2012 |
| DE | 102013210169 | A1 | 12/2014 |
| DE | 102018203304 | A1 | 9/2019 |
| EP | 2268926 | B1 | 8/2011 |
| EP | 2434164 | | 3/2012 |
| EP | 2434164 | A1 | 3/2012 |
| EP | 3081779 | | 10/2016 |
| EP | 3081779 | A1 | 10/2016 |
| EP | 3591237 | A1 | 1/2020 |
| EP | 3006679 | B1 | 9/2023 |
| FR | 3122450 | A1 | 11/2022 |
| GB | 2408546 | A | 6/2005 |
| GB | 2477745 | A | 8/2011 |
| JP | 2003227497 | A | 8/2003 |
| KR | 200930757 | A | 3/2009 |
| KR | 1025867 | B1 | 3/2011 |
| KR | 1387391 | B1 | 4/2014 |
| WO | 2014098276 | A1 | 6/2014 |
| WO | 2022229555 | A2 | 11/2022 |

* cited by examiner

ACTIVE FAN TIP TREATMENT USING ROTATING DRUM ARRAY IN FAN TRACK LINER WITH AXIAL AND CIRCUMFERENTIAL CHANNELS FOR DISTORTION TOLERANCE

STATEMENT REGARDING FEDERALLY SPONSORED RESEARCH OR DEVELOPMENT

Embodiments of the present disclosure were made with government support under Contract No. FA8650-19-D-2063 or FA8650-19-F-2078. The government may have certain rights.

FIELD OF THE DISCLOSURE

The present disclosure relates generally to gas turbine engines, and more specifically to fan assemblies for gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

In embedded gas turbine engine applications, the engine may experience high distortion in the form of pressure gradients and swirl. The pressure and swirl distortions may cause engine stall or other undesirable aeromechanical behavior. The fan of the gas turbine engine may include mitigation systems to reduce or minimize the negative effects of pressure and swirl distortions to improve stall margin of the engine.

SUMMARY

The present disclosure may comprise one or more of the following features and combinations thereof.

A fan case assembly is adapted for use with a gas turbine engine. The fan case assembly comprises a case, a plurality of drums, and a control unit.

The case extends circumferentially at least partway about a central axis of the fan case assembly to define an outer boundary of a gas path of the gas turbine engine. The case is formed to define a plurality of internal channels and a plurality of grooves that extend axially at least partway between an axially forward end of the fan case and an axially aft end of the fan case. The plurality of grooves intersect the internal channels.

Each one of the plurality of drums is disposed in a corresponding one of the plurality of grooves of the fan case and are spaced circumferentially about the central axis. Each drum of the plurality of drums is shaped to include a passageway that extends through the corresponding drum. Each drum of the plurality of drums is configured to rotate about a respective drum axis between a closed position and an open position.

In the closed position, the passageway of the corresponding drum is positioned to block fluid communication between the passageway and at least one of the internal channels. In the open position, the passageway of the corresponding drum is positioned to allow fluid communication between the gas path and the at least one internal channel through the passageway, and The control unit is configured to rotate the plurality of drums about the respective drum axis between the closed position and the open position in response to preselected operating conditions to minimize negative effects pressure and swirl distortions in the gas turbine engine to improve stall margin.

In some embodiments, each one of the plurality of internal channels extends axially and circumferentially though the case.

In some embodiments, each one of the plurality of internal channels includes a first end and a second end. The first end is spaced apart from the second end in the axial and circumferential direction.

In some embodiments, the plurality of drums includes a first drum and a second drum spaced circumferentially apart from the first drum. In the open position, the first end of the internal channel is in fluid communication with the passageway of a first drum and the second end of the internal channel is in fluid communication with the passageway of the second drum.

In some embodiments, the passageway of the first drum is disposed axially forward of the passageway of the second drum.

In some embodiments, each drum of the plurality of drums is shaped to form a forward passageway and an aft passageway disposed axially aft of the forward passageway.

In some embodiments, each one of the plurality of internal channels extends between the forward passageway of a first one of the plurality of drums and the aft passageway of a second one of the plurality of drums.

In some embodiments, when looking axially along the drum axis, a profile of the passageway is L shaped.

In some embodiments, in the open position, a first portion of the L shaped passageway is aligned with one of the plurality of internal channels and a second portion of the L shaped passageway faces radially towards the gas path in fluid communication with the gas path.

In some embodiments, the plurality of internal channels include a circumferential channel and an axial channel.

In some embodiments, the plurality of drums includes a first drum and a second drum. The circumferential channel extends between the first drum and the second drum.

In some embodiments, the plurality of drums includes a third drum. The second drum is disposed circumferentially between the first drum and the third drum. The axial channel extends axially and circumferentially between the second drum and the third drum.

In some embodiments, when looking axially along the drum axis, a profile of the passageway of the second drum is T shaped.

In some embodiments, the control unit is configured to rotate the first drum, the second drum, and the third drum independent of one another and position the first drum and the third drum in the open position and the second drum in a bypass position.

In some embodiments, in the bypass position, a first portion of the T shaped passageway of the second drum is aligned with the circumferential channel and the internal channel to allow fluid communication between the passageway of the first drum, the circumferential channel, the passageway of the second drum, the internal channel, and the passageway of the third drum.

In some embodiments, in the bypass position a second portion of the T shaped passageway faces radially away from the gas path to block fluid communication between the T shaped passageway of the second drum and the gas path.

In some embodiments, a gas turbine engine comprises a fan and a fan case assembly. The fan includes a fan rotor configured to rotate about an axis of the gas turbine engine and a plurality of fan blades coupled to the fan rotor for rotation therewith. The fan case assembly is adapted for use with the gas turbine engine. The fan case assembly comprises a case, a plurality of drums, and a control unit.

The case extends circumferentially at least partway about a central axis of the fan case assembly to define an outer boundary of a gas path of the gas turbine engine. The case is formed to define a plurality of internal channels and a plurality of grooves that extend axially at least partway between an axially forward end of the fan case and an axially aft end of the fan case. The plurality of grooves intersect the internal channels.

Each one of the plurality of drums is disposed in a corresponding one of the plurality of grooves of the fan case and spaced circumferentially about the central axis. Each drum of the plurality of drums is shaped to include a passageway that extends through the corresponding drum. Each drum of the plurality of drums is configured to rotate about a respective drum axis between a closed position and an open position.

In the closed position, the passageway of the corresponding drum is positioned to block fluid communication between the passageway and at least one of the internal channels. In the open position, the passageway of the corresponding drum is positioned to allow fluid communication between the gas path and the at least one internal channel through the passageway.

The control unit is configured to rotate the plurality of drums about the respective drum axis between the closed position and the open position in response to preselected operating conditions to minimize negative effects pressure and swirl distortions in the gas turbine engine to improve stall margin.

In some embodiments, each drum of the plurality of drums forms a forward passageway and an aft passageway disposed axially aft of the forward passageway.

In some embodiments, each one of the plurality of internal channels extends between the forward passageway of a first one of the plurality of drums and the aft passageway of a second one of the plurality of drums.

In some embodiments, a method comprises providing a fan case assembly adapted for use with a gas turbine engine. The fan case assembly includes a case and a plurality of drums. The case extends circumferentially at least partway about a central axis of the gas turbine engine and is formed to define an outer boundary of a gas path of the gas turbine engine. The case is formed to the case formed to define a plurality of internal channels.

The plurality of drums are arranged in axial grooves intersecting the internal channels. Each drum of the plurality of drums is shaped to include a passageway that extends through the corresponding drum. Each drum of the plurality of drums is configured to rotate about a respective drum axis.

In some embodiments, the method includes locating the plurality of drums in a closed position in which the passageway of the corresponding drum is positioned to block fluid communication between the passageway and at least one of the internal channels.

In some embodiments, the method includes rotating the plurality of drums to an open position in which the passageway of the corresponding drum is positioned to allow fluid communication between the gas path and the at least one internal channel.

These and other features of the present disclosure will become more apparent from the following description of the illustrative embodiments.

DETAILED DESCRIPTION OF THE DRAWINGS

Figure 1:
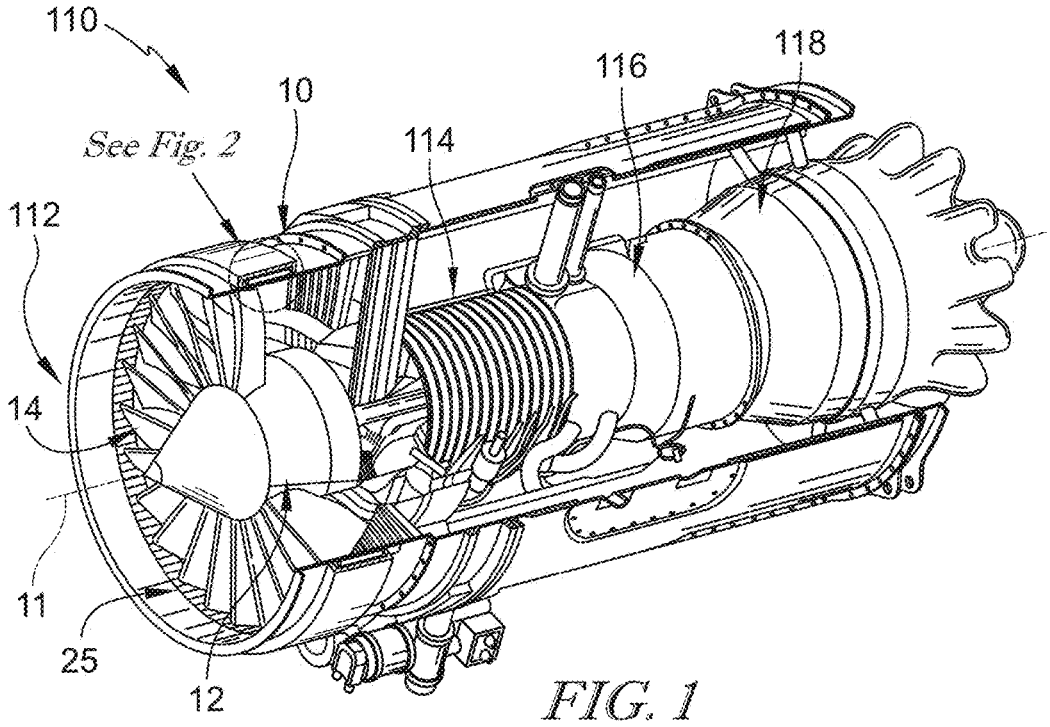
FIG. 1 is a cutaway view of a gas turbine engine.

For the purposes of promoting an understanding of the principles of the disclosure, reference will now be made to a number of illustrative embodiments illustrated in the drawings and specific language will be used to describe the same.

A fan case assembly 10 is adapted for use in a gas turbine engine 110 as shown in FIG. 1. The gas turbine engine 110 includes a fan 112, a compressor 114, a combustor 116, and a turbine 118 as shown in FIG. 1. The fan 112 is driven by the turbine 118 and provides thrust for propelling an aircraft. The compressor 114 compresses and delivers air to the combustor 116. The combustor 116 mixes fuel with the compressed air received from the compressor 114 and ignites the fuel. The hot, high pressure products of the combustion reaction in the combustor 116 are directed into the turbine 118 to cause the turbine 118 to rotate about a central axis 11 of the gas turbine engine 110 and drive the compressor 114 and the fan 112.

The fan 112 includes a fan rotor 12 and a fan case assembly 10 as shown in FIG. 1. The fan rotor 12 has a number of fan blades 14 with a leading edge 16 and a trailing edge 18. The fan case assembly 10 extends circumferentially around the fan blades 14 of the fan rotor 12 such that the fan case assembly 10 is aligned axially with the fan blades 14.

Figure 2:
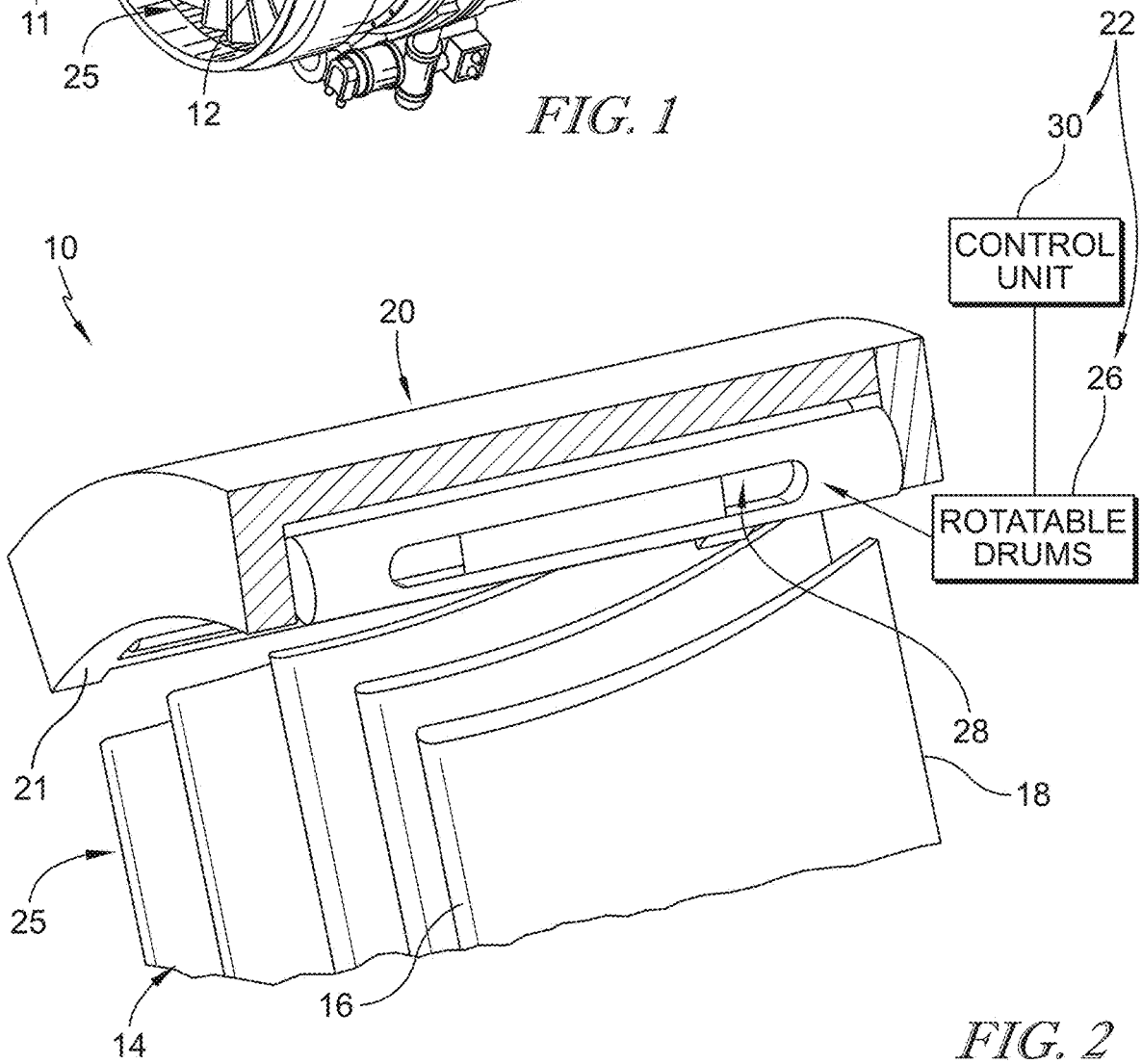
FIG. 2 is a detail view of the fan case assembly included in the gas turbine engine of FIG. 1.
Figure 3:
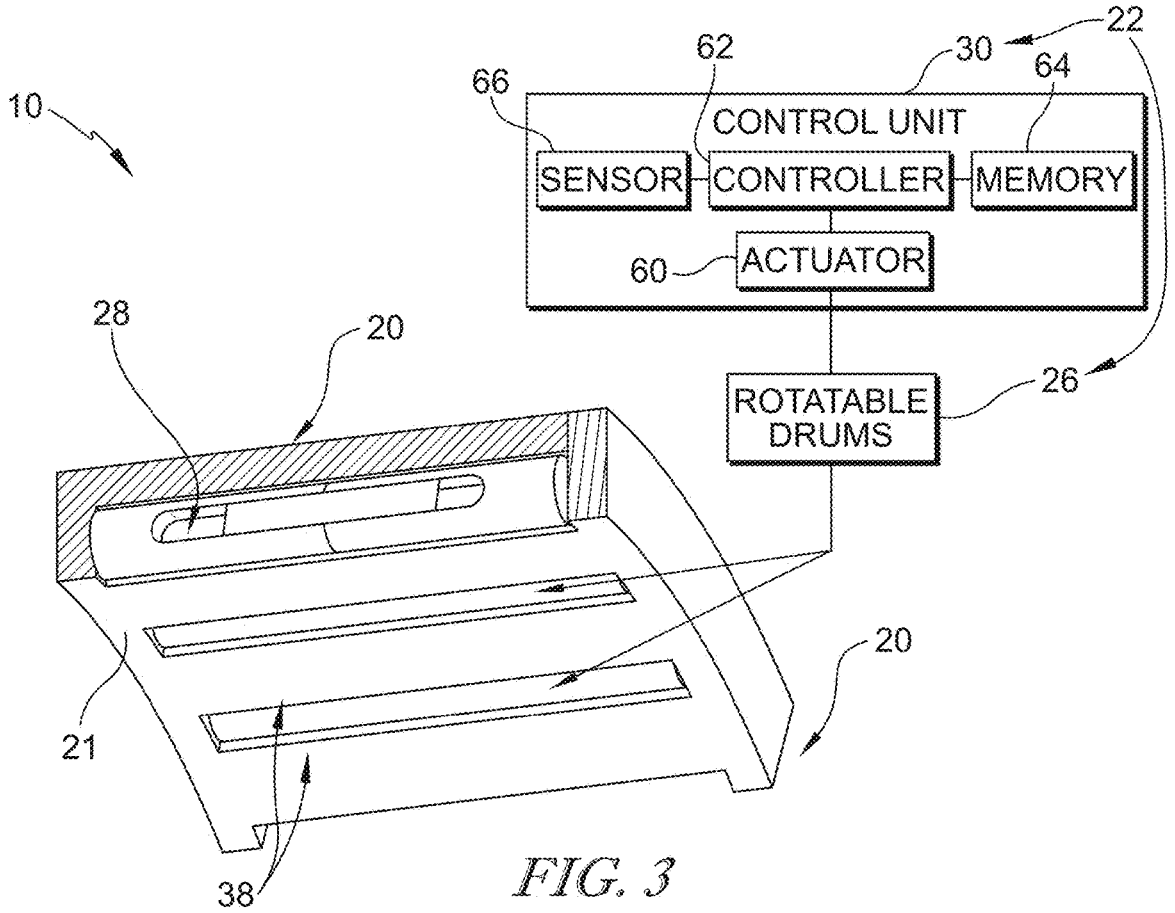
FIG. 3 is a perspective view of the fan case assembly of FIG. 2.
Figure 4:
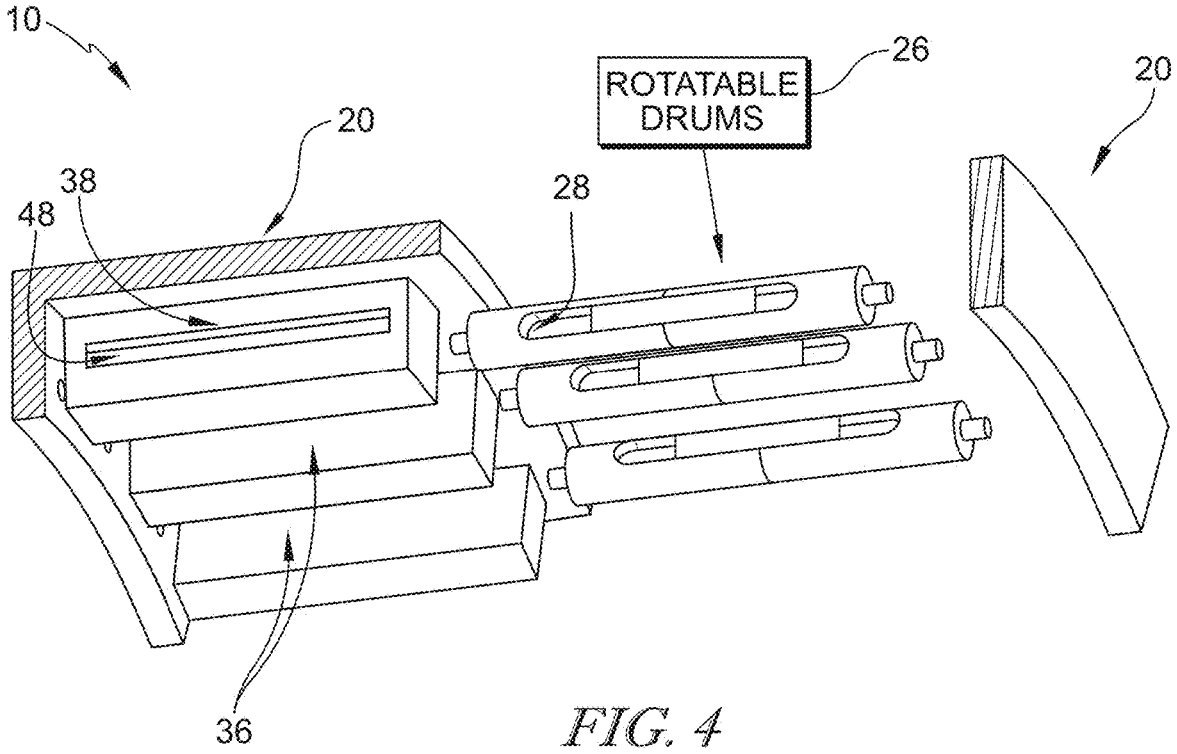
FIG. 4 is an exploded view of the fan case assembly of FIG. 3.

The fan case assembly 10 includes, among other components, a case 20 and an inlet distortion mitigation system 22 as shown in FIGS. 2-4. The fan case assembly 10 is adapted for use with a gas turbine engine 110 as shown in FIG. 1. The fan case assembly 10 comprises a case 20. The case 20 extends circumferentially at least partway about a central axis 11 of the fan case assembly 10. The case 20 defines an outer boundary 21 of a gas path 25 of the gas turbine engine 110. The case 20 is formed to define a plurality of internal channels 48. The case 20 is formed to define a plurality of grooves 36. The grooves 36 extend axially at least partway between an axially forward end of the fan case 20 and an axially aft end of the fan case 20. The plurality of grooves 36 intersect the internal channels 48 formed by the fan case 20.

As shown in FIGS. 2-4, the inlet distortion mitigation system 22 includes a plurality of rotatable drums 26 arranged in grooves 36 of the case 20 and a control unit 30. Each one of the plurality of drums 26 is disposed in a corresponding one of the plurality of grooves 36 formed by the fan case 20. The plurality of rotatable drums 26 are spaced circumferentially about the central axis 11 of the gas turbine engine 110. Each of the drums 26 is shaped to include a passageway 28 that extends through the drum 26. In some embodiments, only some of the drums 26 may have a passageway 28. Each drum 26 is configured to rotate about a respective drum axis between a closed position and an open position.

Figure 6A:
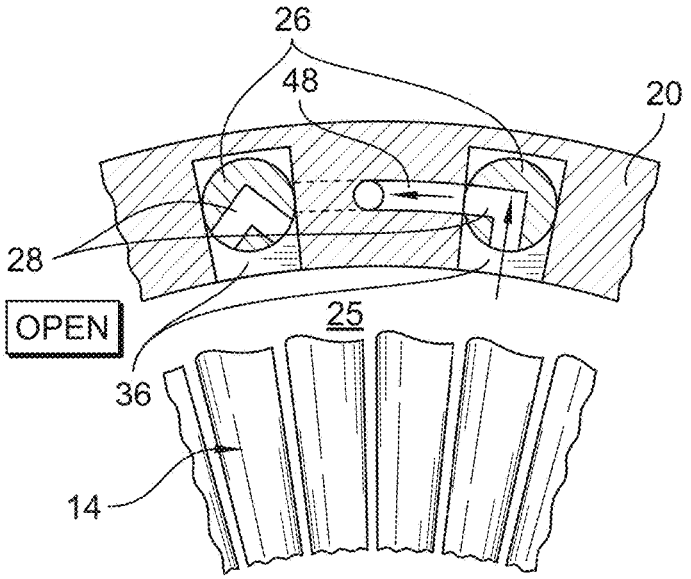
FIG. 6A is an axial cross-section view of a portion of the fan case assembly of FIG. 5.
Figure 6B:
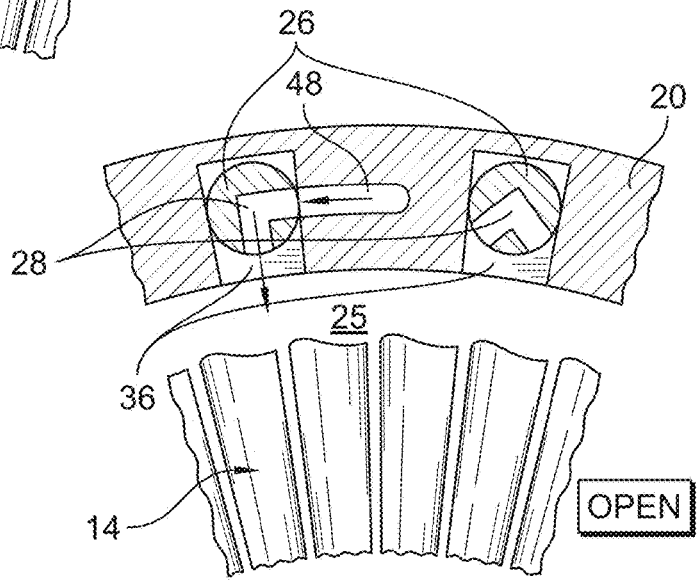
FIG. 6B is an axial cross-section view of a portion of the fan case assembly of FIG. 5.
Figure 7:
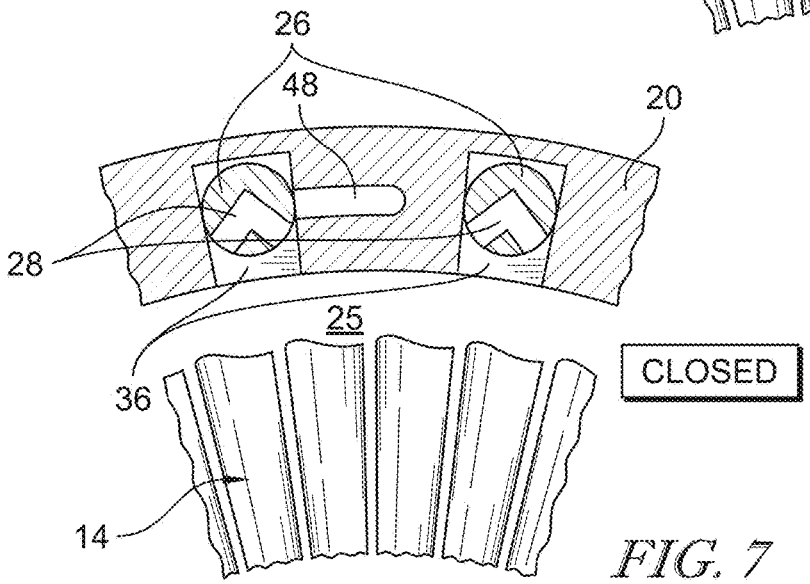
FIG. 7 is an axial cross-section view of a portion of the fan case assembly of FIG. 5.
Figure 9A:
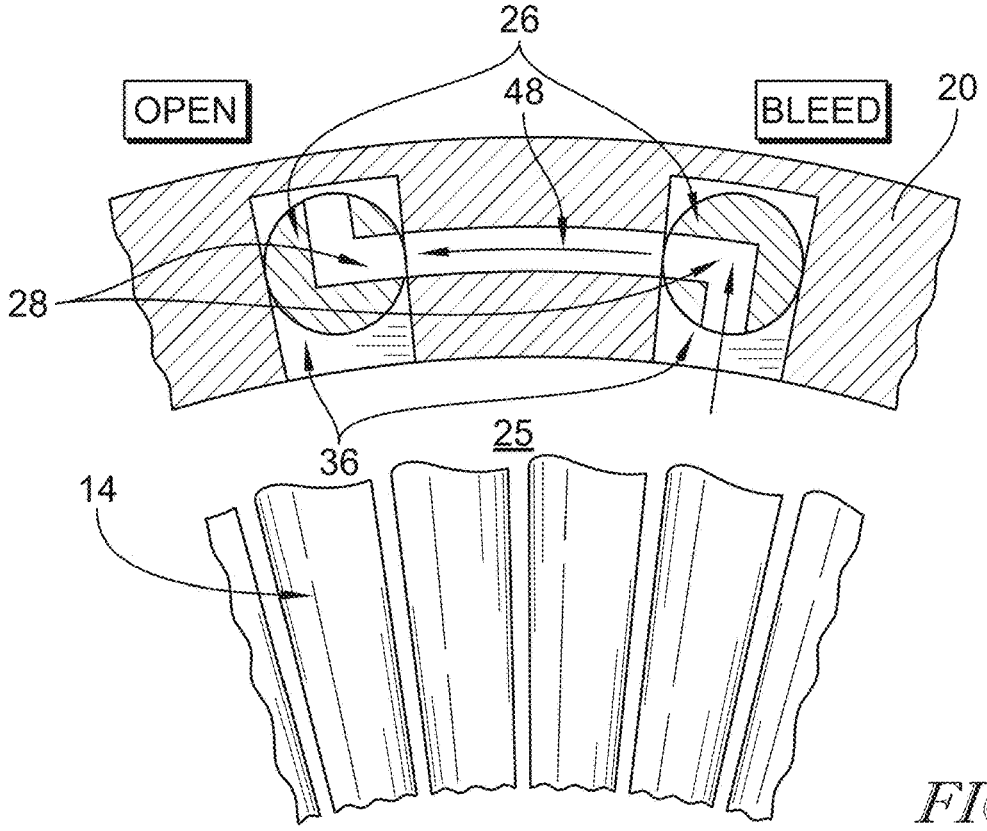
FIG. 9A is an axial cross-section view of a portion of the fan case assembly of FIG. 8.
Figure 9B:
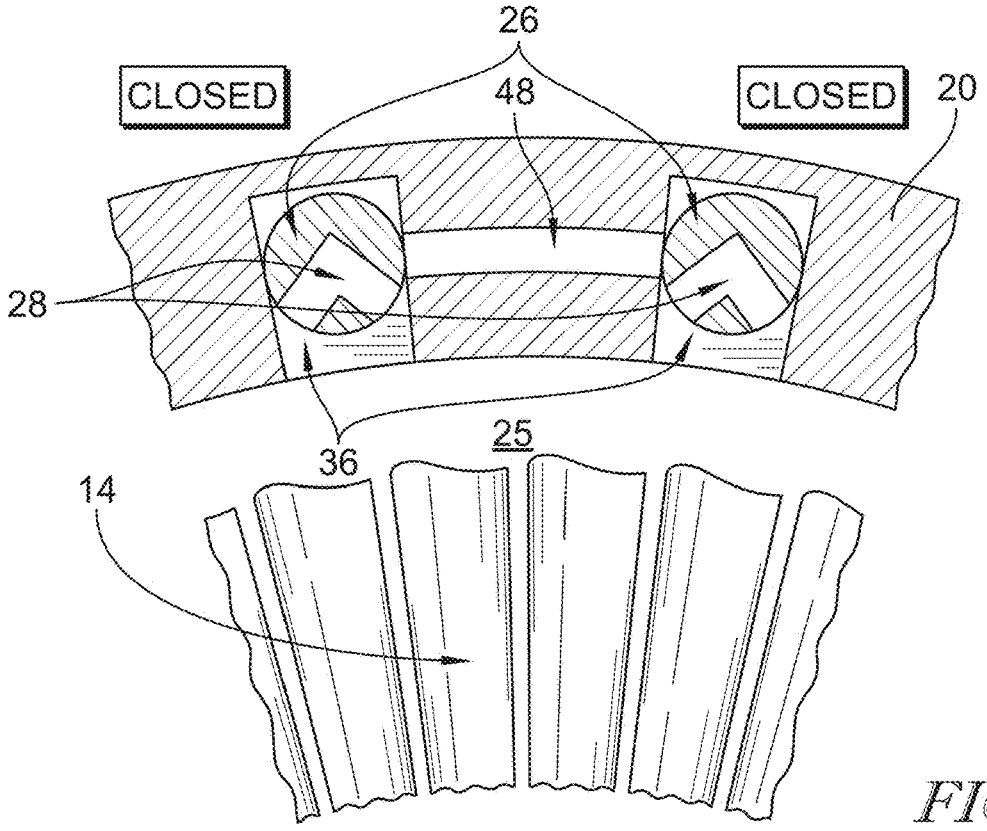
FIG. 9B is an axial cross-section view of a portion of the fan case assembly of FIG. 8.

In the closed position, as shown in FIGS. 7 and 9B the passageway 28 of the corresponding drum 26 is positioned to block fluid communication between the passageway 28 and at least one of the internal channels 48. In the open position, as shown in FIGS. 6A, 6B, 9A, and 9C the passageway 28 of the corresponding drum 26 is positioned to allow fluid communication between the gas path 25 and at least one of the internal channels 48 through the passageway 28. The fan case assembly 10 comprises a control unit 30 including one or more sensor 66, controller 62, memory 64, and/or actuator 60 to rotate the drums 26.

The control unit 30 is configured to rotate the plurality of drums 26 about the respective drum axis between the closed position, the open position, and a bypass position. The control unit 30 is configured to rotate the drums 26 between the open positon, the closed position, and the bypass position in response to preselected operating conditions to minimize negative effects pressure and swirl distortions in the gas turbine engine 110 to improve stall margin. The control unit 30 is configured to rotate each of the plurality of drums 26 about the corresponding drum axis A between the different positions in response to preselected operating conditions to control tip treatment of the fan blades 14.

The control unit 30 is configured to rotate each of the drums 26 to control whether the passageways 28 in each drum 26 face toward or away from the gas path 25, thereby controlling whether the passageways 28 are in fluid communication with the gas path 25 to recirculate air at the tips of the fan blades 14. The control unit 30 controls the application of the tip treatment to the fan blades 14 so as to minimize the negative effects of pressure and swirl distortions in the gas turbine engine 110 to improve stall margin for the gas turbine engine 110.

The control unit 30 is configured to rotate the drums 26 between the different positions in response to preselected operating conditions. The preselected operating conditions include a plurality of preprogrammed aircraft maneuvers stored on a memory 64 included in the control unit 30. The plurality of preprogrammed aircraft maneuvers include banks, turns, rolls, etc.

The control unit 30 is configured to detect a preprogrammed aircraft maneuver included in the plurality of preprogrammed aircraft maneuvers on the memory 64. Once the preprogrammed aircraft maneuver is detected, the control unit 30 directs each of the drums 26 to rotate to a corresponding position in response to detecting the preprogrammed aircraft maneuver.

For example, the plurality of drums 26 may normally be in the closed position during a cruise condition so that no additional stall margin is created, but performance is not compromised. The cruise condition included in the preselected operating conditions corresponds to when the aircraft is in the cruise portion of the flight cycle.

Then, when the control unit 30 detects a preprogrammed aircraft maneuver, i.e. banks, turns, rolls, the control unit 30 directs the drums 26 to rotate to the open position so that the passageways 28 face toward the gas path 25 and flow is permitted into the passageways 28. The passageways 28 allow for air to recirculate at the tips of the fan blades 14.

Conversely, when the control unit 30 detects the cruise condition after a preprogrammed aircraft maneuver, the control unit 30 may be configured to direct the drums 26 to rotate to the closed position. Therefore, once the aircraft maneuver is completed, the drums 26 rotate to the closed position to remove the opening created in the outer boundary of the gas path 25 by the passageways 28 so that performance is not compromised and the additional stall margin is removed during the cruise condition.

The control unit 30 is configured to direct some or all of the drums 26 to rotate from the closed position to the open position based on the detected preprogrammed aircraft maneuver. Depending on the preprogrammed aircraft maneuver, the control unit 30 may direct only certain drums 26 to move to the open position, while keeping others in the closed position.

The preselected operating conditions may further include a sensor input from at least one sensor 66 included in the control unit 30. The sensor 66 is configured to measure one of pressure, air speed, altitude, blade tip timing, blade rotational speed, attitude or aircraft orientation, and acceleration. In some embodiments, the control unit 30 includes a plurality of sensors 66 each configured to measure one of pressure, air speed, altitude, blade tip timing, blade rotational speed, attitude or aircraft orientation, and acceleration.

The control unit 30 is configured to receive a measurement from the at least one sensor 66 or sensors 66 and direct the drums 26 to rotate to a corresponding position in response to the measurement of the at least one sensor 66. The control unit 30 may be configured to rotate the drums 26 to be in the closed position when the measurements from the sensor 66 are within a predetermined threshold.

Then, when the measurement from the sensor 66 is outside of the predetermined threshold, the control unit 30 directs the drums 26 to rotate to the open position. Based on the difference of the measurement from the sensor 66 compared to the predetermined threshold, the control unit 30 may vary the position of the drums 26 to control whether tip treatment is applied to the fan blades 14 of the fan 112. The control unit 30 may rotate certain drums 26 located circumferentially about the fan 112 to apply tip treatment at different areas around the fan 112. For example, the control unit 30 may direct certain drums 26 to be in the open position to open the passageways 28 of the corresponding drums 26 to the gas path 25 to allow air recirculation at that circumferential location about the fan 112.

The control unit 30 is configured to direct some or all of the drums 26 to rotate from the closed position to the open position based on the measurement from the sensor 66. The control unit 30 may direct some of the drums 26 to remain in the closed position, while directing some of the drums 26 to rotate to the opened position based on the measurement from the sensor 66.

In some embodiments, the control unit 30 may be configured to use a combination of the sensor measurements and the detected preprogrammed aircraft maneuver to control the position of the plurality of drums 26. For example, when the control unit 30 detects a preprogrammed aircraft maneuver and the measurement is outside of the predetermined threshold, the control unit 30 directs some or all of the drums 26 to rotate to the open position. The control unit 30 is configured to individual vary the angle of the passageways 28 of each of the drums 26.

In some embodiments, the control unit 30 is configured to use the measurements from the sensor 66 to anticipate the aircraft maneuver. The control unit 30 is configured to direct some or all of the plurality of drums 26 to move to the open position in response to the measurement from the sensor 66 even though no preprogrammed aircraft maneuver is detected.

Alternatively, there may be a delay in the measurements from the sensor 66. Therefore, the control unit 30 is also configured to direct some or all of the drums 26 to move to the open position when the one of the preprogrammed aircraft maneuvers is detected, even though the measurements from the sensor 66 are within the predetermined thresholds.

In some embodiments, the control unit 30 may detect one of the preprogrammed aircraft maneuvers, but the measurements from the sensors 66 are within the predetermined threshold. If so, the control unit 30 may direct some or all of the drums 26 to remain in the current position.

In some embodiments, the inlet distortion mitigation system 22 may utilize a machine learning algorithm. The machine learning algorithm may track inputs, for example, aircraft speed, orientation, altitude, and/or fan speed versus a fan response, as well positioning of the drums 26, and learn how to move the inlet distortion mitigation system 22 to minimize stall margin loss. The mitigation system 22 may utilize the machine learning algorithm to gather data collected from the sensors 66 and/or other systems integrated with the engine 110 and evaluate the data, for example, to learn the correlation between certain environmental factors and/or inputs and stall margin. The algorithm may determine and learn how to minimize stall margin loss based on evaluation of the data collected, and be used by the system 22 to anticipate unfavorable conditions and better control the drums 26 to mitigate stall margin loss.

Figure 5:
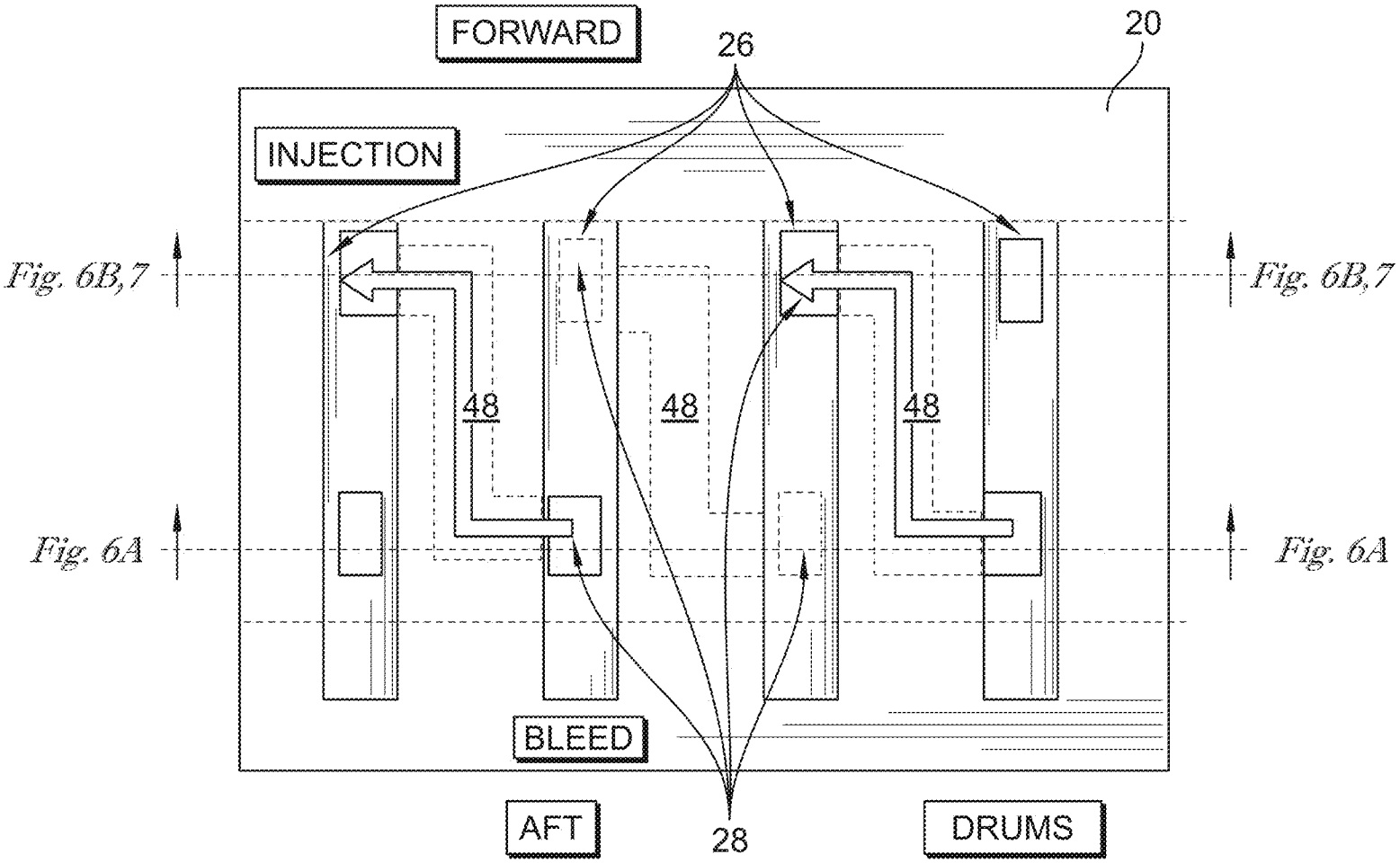
FIG. 5 is radially outward facing view of a radially inner surface of a fan case assembly.
Figure 8:
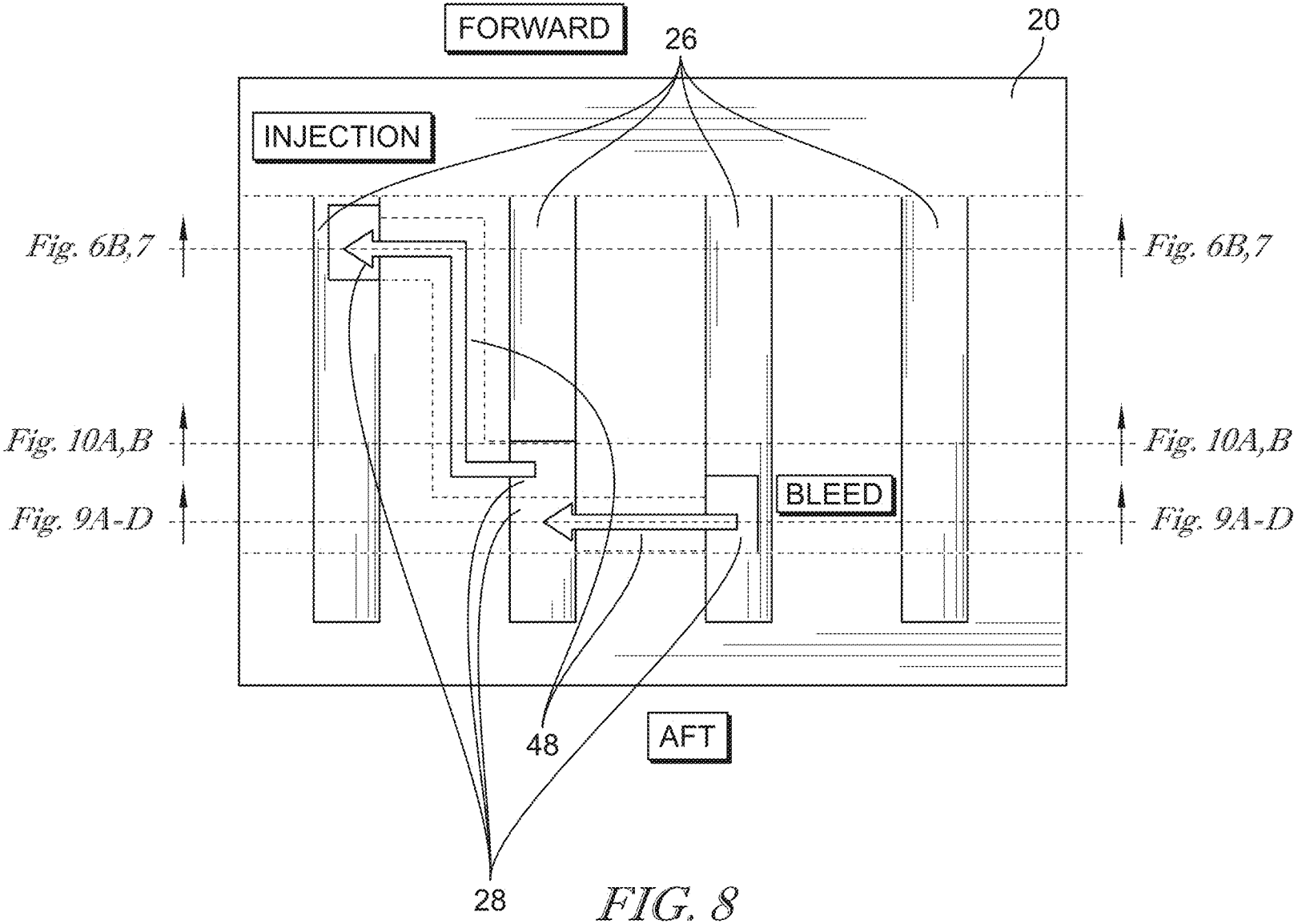
FIG. 8 is radially outward facing view of a radially inner surface of a fan case assembly.

In some embodiments, at least some of the internal channels 48 extends axially through the case 20, as shown in FIGS. 5 and 8. In some embodiments, at least some of the the internal channels 48 extend circumferentially though the case 20, as shown in FIGS. 5 and 8. In some embodiments, at least some of the internal channels 48 extend axially and circumferentially thought the case 20, as shown in FIGS. 5 and 8. In some embodiments, the internal channels 48 include a first end and a second end. In some embodiments, as shown in FIGS. 5 and 8, the first end is spaced apart from the second end in the axial and circumferential direction.

In some embodiments, the plurality of drums 26 includes a first drum and a second drum spaced circumferentially apart from the first drum, as shown in FIGS. 6A,-7 and 9A-9D. In the open position, as shown in FIGS. 6A, 6B, 9A, and 9C, the first end of the internal channel 48 is in fluid communication with the passageway 28 of a first drum 26, and the second end of the internal channel 48 is in fluid communication with the passageway 28 of the second drum 26. In some embodiments, the passageway 28 of the first drum 26 is disposed axially forward of the passageway 28 of the second drum 26, as shown in FIGS. 5 and 8, where gas is bled from the gas path 25 at one of the drums 26 (for example, at an aft opening of the drum 26), flows through the passageway 28 of the drums and the internal channel 48, and is injected back into the gas path 25 at the other drum 26 (for example, at a forward opening of the drum 26).

In some embodiments, the drums 26 are shaped to form a forward passageway 28 and an aft passageway 28 disposed axially aft of the forward passageway, as shown in FIGS. 5 and 8. The plurality of internal channels 48 extend between the forward passageway 28 of a first one of the plurality of drums 26 and the aft passageway 28 of a second one of the plurality of drums 26.

In some embodiments, a profile of the passageway 28 is L shaped when looking axially along the drum axis, as shown in FIGS. 6A-7 and 9A-9B. In the open position, as shown in FIGS. 6A-6B and 9A, a first portion of the L shaped passageway 28 is aligned with one of the plurality of internal channels 48 and a second portion of the L shaped passageway 28 faces radially towards the gas path 25 in fluid communication with the gas path 25.

In some embodiments, the internal channels 48 include a circumferential channel 48, as shown in FIGS. 8 and 9A-9D. In some embodiments, as shown in FIGS. 9 5, 6A-8, the internal channels 48 include a channel 48 with a circumferential portion. In some embodiments, the internal channels 48 include a channel 48 that has an axial channel 48 and/or an axial portion of the channel 48, as shown in FIGS. 5-8.

In some embodiments, the plurality of drums 26 includes a first drum 26 and a second drum 26, as shown in FIGS. 6A-7 and FIGS. 9A-9D. In some embodiments, the circumferential channel 48 extends between the first drum 26 and the second drum 26, as shown in FIGS. 8 and 9A-9D. In some embodiments, a circumferential portion of the internal channel 48 extends between the first drum 26 and the second drum 26, as shown in FIGS. 6A-7. In some embodiments, the plurality of drums 26 includes a third drum 26. In some embodiments, the second drum 26 is disposed axially and circumferentially between the first drum 26 and the third drum 26. The passageway 28 of the second drum 26 allows the gas to flow both circumferentially and axially within the second drum 26 from the circumferential channel 48 to the axial channel 48. The axial channel 48 extends axially and circumferentially between the second drum 26 and the third drum 26, as shown in FIGS. 8-10B.

Figure 9C:
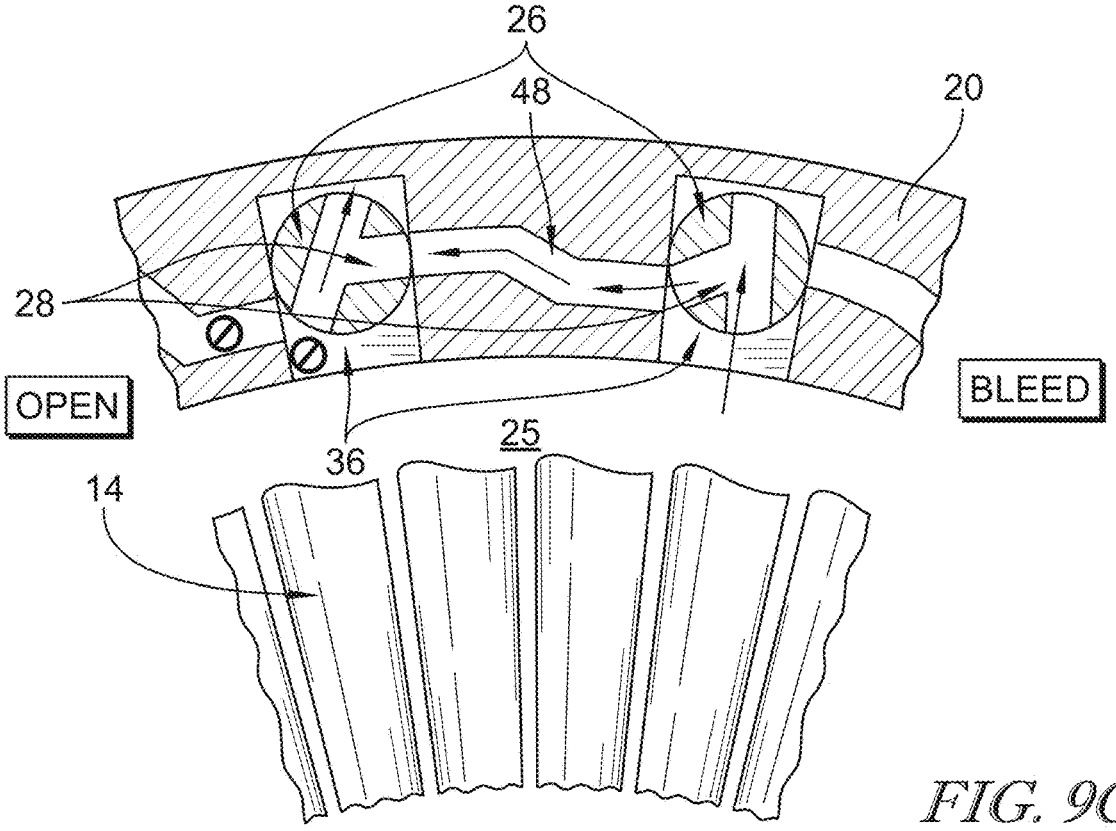
FIG. 9C is an axial cross-section view of a portion of the fan case assembly of FIG. 8.
Figure 9D:
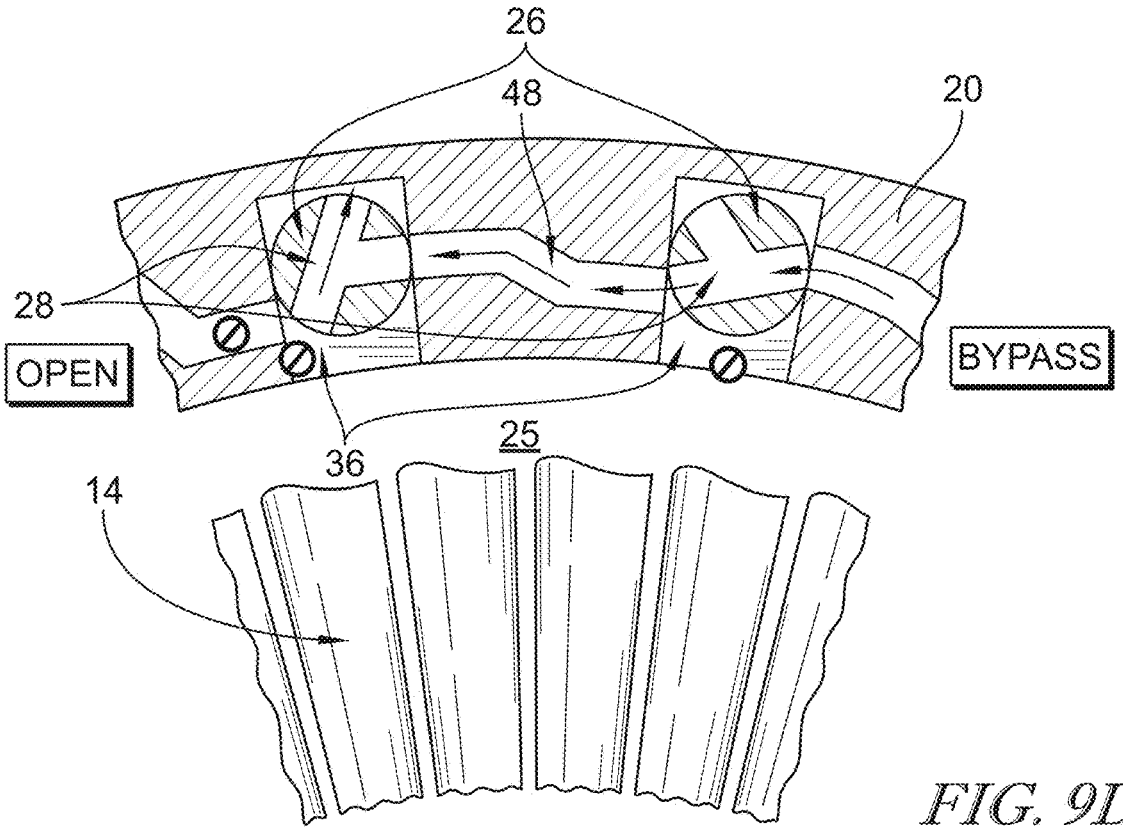
FIG. 9D is an axial cross-section view of a portion of the fan case assembly of FIG. 8.

In some embodiments, a profile of the passageway 28 of the second drum 26 is generally T shaped when looking axially along the drum axis. In some embodiments, the controller 30 is configured to rotate the first drum 26, the second drum 26, and the third drum 26 independent of one another. The controller 30 is configured to rotate the first drum 26 and the third drum 26 to the open position and the second drum 26 in a bypass position as shown in FIGS. 8 and 9C-9D.

In some embodiments, in the bypass position, a first portion of the T shaped passageway 28 of the second drum 26 is aligned with the circumferential channel 48 and an internal channel 48 with an axial portion to allow fluid communication between the passageway 28 of the first drum 26, the circumferential channel 48, the passageway of the second drum 26, the internal channel 48, and the passageway 28 of the third drum 26, as shown in FIG. 8. In some embodiments, in the bypass position, a second portion of the T shaped passageway 28 faces radially away from the gas path 25 to block fluid communication between the T shaped passageway 28 of the second drum 26 and the gas path 25.

In some embodiments, the passageways 28 in the first and second drums 26 on either side of the circumferential channel 48 are shaped to allow gas to be bled from the gas path 25 into the passageway 48 of the first drum, through the circumferential channel 48, and into the passageway 48 of the second drum 26. The first drum 26 is rotated and/or positioned to either allow or block bleed air from the gas path 25 into the passageway 48 of the first drum, as shown in FIGS. 8 and 9A-9D.

Figure 10A:
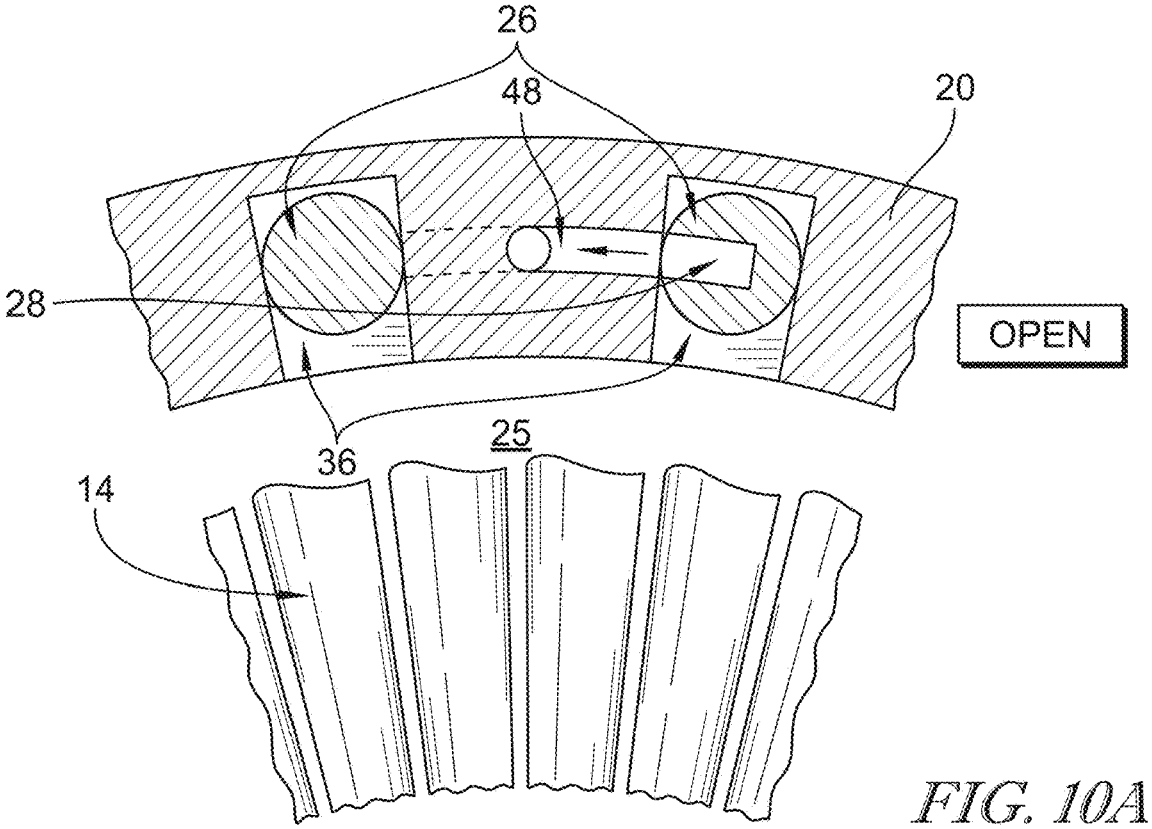
FIG. 10A is an axial cross-section view of a portion of the fan case assembly of FIG. 8.
Figure 10B:
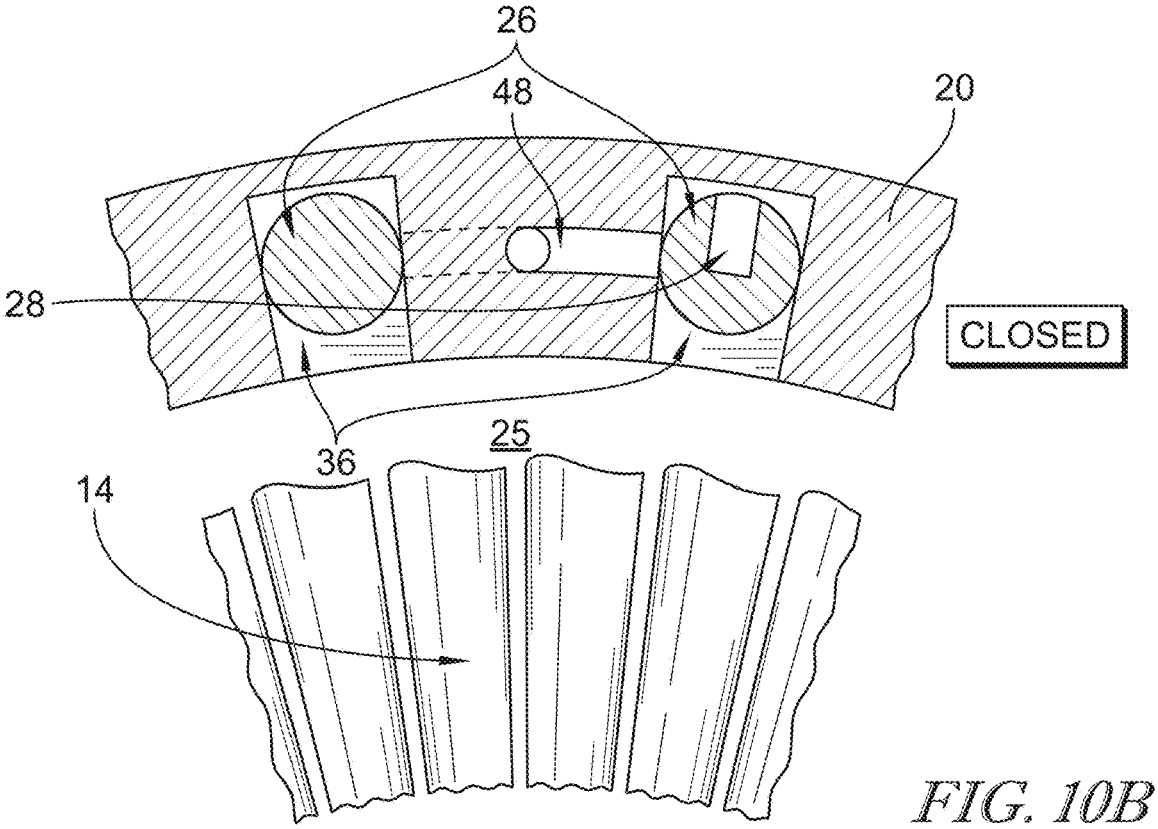
FIG. 10B is an axial cross-section view of a portion of the fan case assembly of FIG. 8.

In some embodiments, the passageway 28 of the second drum 26 is shaped to allow axial flow of gas received from the first drum 26, through the second drum 26, and to the axial channel 48 between the second drum 26 and the third drum 26. The second drum 26 may be rotated and/or positioned to allow or block flow from the first drum 26 into the axial channel 48 as shown in FIGS. 8 and 10A-10B.

Figure 11:
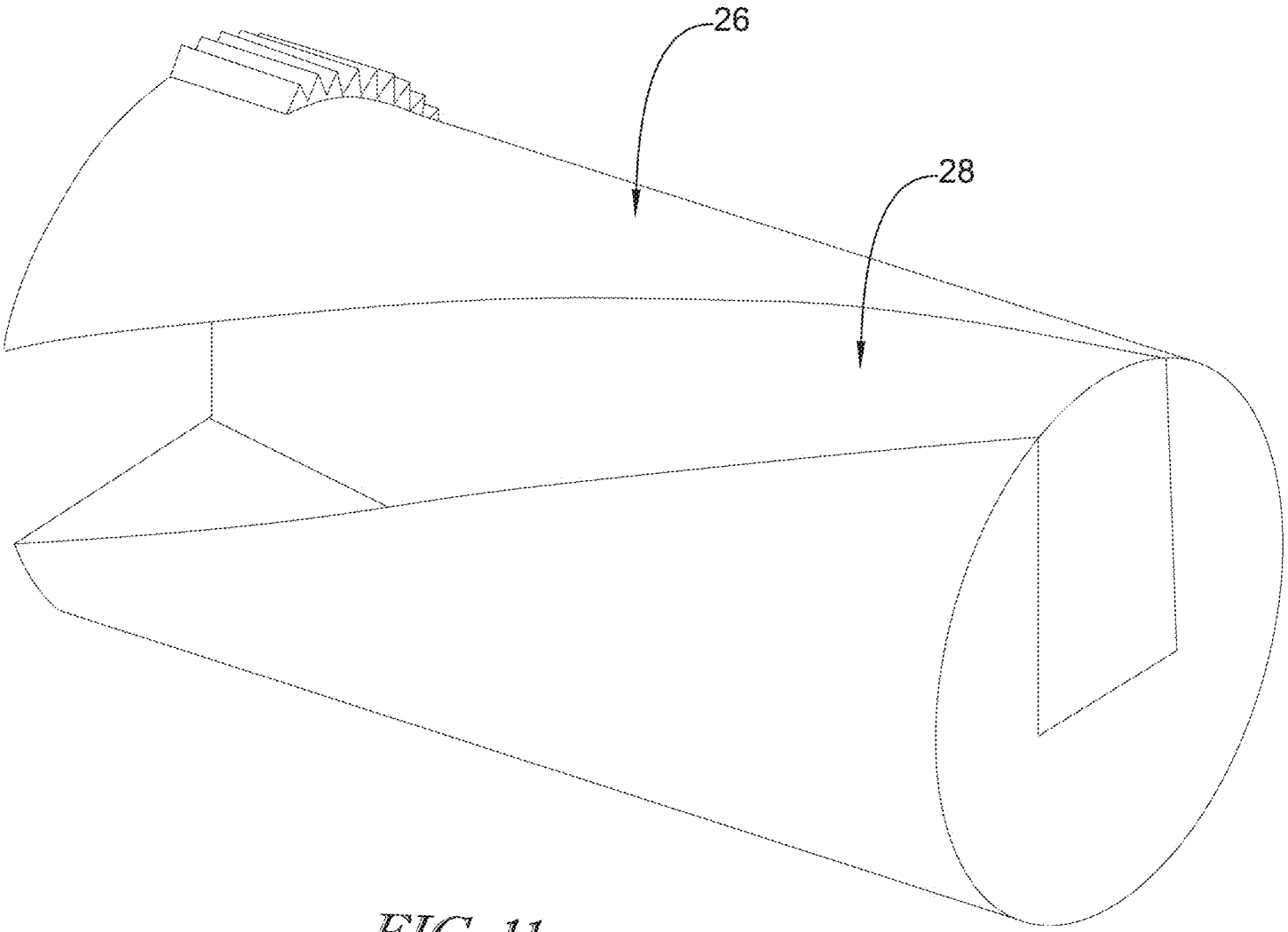
FIG. 11 is a perspective view of an embodiment of a second drum of the fan case of FIG. 8.

In some embodiments, the passageway 28 of the second drum 26 is a helix shaped slot, as shown in FIG. 11, enabling gas to be drawn from the first (or aft) drum 26, through the passageway 28 of the second drum 26 having a vertical slot at the aft end of the second drum 26 (or a slot that is, for example, 30 degrees past top dead center clockwise). The passageway 28 of the second drum 26 may then twist and/or curve around a drum axis of the second drum 26 and extend from the vertical slot at the aft end to a horizontal slot at the forward end of the second drum 26 (or a slot that is, for example, 90 degrees counter clockwise, when the second drum 26 is open), and enable the gas to flow into the axial channel 48 between the second and third drums 26.

In some embodiments, the passageways 48 of the first and second drums 26 may be shaped to only allow air flow between the two drums and not to further circumferential drums 26, grooves 36, and/or other circumferential channels 48 outside of the first and second drums 26, as shown in FIGS. 9A-9B. In some embodiments, the circumferential channel 48 extends further around the case 20, past the first and second drums 26. The passageways 48 of the first and/or second drums 26 are shaped to allow the gas through the circumferential channel 48 past the first and/or second drums 26 (bypassing the first and/or second drum 26 as shown in FIG. 9D).

In some embodiments, the passageway 28 of the third drum is shaped to allow flow from the axial channel 48, though the passageway 28 of the third drum 26, and into the gas path 25. The third drum 26 may be positioned and/or rotated to allow or block flow of gas from the axial channel 48 into the gas path as shown in FIGS. 8 and 6B-7.

In some embodiments, a method includes providing a fan case assembly 10 adapted for use with a gas turbine engine 110, as shown in FIGS. 1-2. The fan case assembly 10 includes a case 20 that extends circumferentially at least partway about a central axis 11 of the gas turbine engine 110. The case 20 is formed to define an outer boundary 21 of a gas path of the gas turbine engine 110. The case 20 is formed to define a plurality of internal channels 48 and grooves 36 intersecting the internal channels 48, as shown in FIGS. 5-9D. The case 20 is formed to define plurality of drums 26 arranged in the axial grooves 36 intersecting the internal channel 48, as shown in FIGS. 2-4. Each drum 26 of the plurality of drums 26 is shaped to include a passageway 28 that extends through the corresponding drum 26, as shown in FIGS. 5-8. Each drum 26 of the plurality of drums 26 is configured to rotate about a respective drum axis.

In some embodiments, the method includes locating the plurality of drums 26 in a closed position, as shown in FIGS. 7 and 9B, in which the passageway 28 of the corresponding drum 26 is positioned to block fluid communication between the passageway 28 and at least one of the internal channels 48. In some embodiments, the method includes rotating the plurality of drums 26 to an open position, as shown in FIGS. 6A-6B, 9A, and 9C, in which the passageway 28 of the corresponding drum 26 is positioned to allow fluid communication between the gas path 25 and at least one of the internal channels 48 through the passageway 28.

Embedded and boundary layer ingestion (BLI) applications may introduce severe distortion in the form of pressure gradients and swirl. A fan, for example, a fan of a gas turbine engine, must survive going through different sectors of their circumference with varying level of pressure or swirl magnitudes, which may be difficult to manage for stall or aeromechanical behavior. Flow distortions induced by different crosswind and flight orientation profiles may generate different flow distortions radially and circumferentially.

In some embodiments, the drums 26 are incorporated with a variable rotating array of drums 26 that may be rotated, as a whole or in smaller groupings, or turned individually to expose the fan tips to the grooves 36 and/or channel 48 via the drums 26. In some embodiments, the drums 26 connect circumferentially to channels 48, making the design relatively more compact and thus can fit in a small airframe better. The drum 26 changes between closed, transferring between flowpath 25 and channel 48, and transferring only between the channels 48 to either side of the drum 26 (not open to flowpath). This may allow for targeted transfer of flows from where there is excess flow and/or pressure to reduced flow and/or pressure. There may remain trades between efficiency and stall margin but in a more compact package potentially.

In some embodiments, the rotating drums 26 are incorporated into the fan case 20 or into liners and may be operated via a variable geometry system similar to variable vanes. It may be easiest to have the variable geometry system perpendicular to the drum 26 rotation axis, but it would also be possible to lay the drums in at an angle and actuate via small bevel gears at the drum 26 ends or similar. This may help offset the flows in the case 20.

In some embodiments, the drums 26 and system 22 permits the fan 112 to operate with the drums 26 limited to retain some efficiency, but then open to the channel 48 when stall margin improvement is desired. The passageways 28 may be located as necessary to treat forward or aft sections of the case 20. The passageways 48 may be shaped to promote desired flow in both conditions.

In some embodiments, as the aircraft maneuvers and inlet flow distortion variations are generated, the drum 26 array may be rotated to provide either improved stall margin or closed to channels 48 to provide best efficiency. This may be beneficial to eliminate a troublesome trade between stall margin and performance potentially, or the system would be able to handle more extreme inlet distortion during maneuvering. In some embodiments, the channels 48 between drums 26 include options to go circumferential or axial and circumferential, the system 22 could be used for a tip injection like flow or a hoop plenum type flow solution.

In some embodiments, the system 22 design trades treated area for radial space, for example, by having fewer openings to the flowpath 25 but also being capable to be radially shorter than the design with a plenum outboard of the drums 26. It takes time for stall to develop so this may be acceptable trade. The drums 26 may be open to flowpath 25 and turn the flow to be tangential and flow in a passageway 28 or channel 48 within the liner/casing 20 space, and then would be turned again to be transferred back into the flowpath 25, as seen in FIGS. 5 and 7.

In some embodiments, it may be possible to include an additional pathway in the drum to permit pass-through without it being open to flowpath 25, which would allow for flows to bypass an opening and transfer to another circumferential location, as seen in FIG. 8. When transferring from or to the flowpath 25 and communicating with the channel 48, the additional pathway in the drums 26 is blocked by the drum interface closed top or outer extent. The air flows from flowpath 25, through the channel 48, and then into flowpath 25 at another location. The channel 48 to either side of this circuit are closed off. In some embodiments, if the local area is neither much higher than average nor much lower than average pressure, the local openings may be closed off (drums 26 not open to flowpath 25) but may still transfer flows around the case using the drum design. This design may provide benefits in being able to control the flows as needed, as well as provide opportunity to integrate into a tip injection layout. One of the challenges of active tip injection is how to extract flows but also be able to turn it off as desired. This design provides a means to control tip injection flows largely within the fan case liners by turning the drums 26.

In some embodiments, while a radially outboard plenum may allow for transfers into and out of it by turning of the drums and relies on self-regulation of the flows (high pressure areas flow in, low pressure areas see flows from it), the design as seen in FIGS. 1-11 may allow for more controlled flows by switching on drums and having passages between specific sectors. It may be relatively more complex but provide more active control. The system 22 design may be used for distortion tolerance in fans. Additionally or alternatively, the design may also be used in a booster or high pressure compressor and thus reduced radial space (vs. a radial plenum) would be even more vital for those applications.

The design shown in FIGS. 1-8 provides benefits in being able to control the flows as needed, as well as provide opportunity to integrate into a tip injection layout. One of the challenges of active tip injection is how to extract flows but also be able to turn it off as desired. The design shown in FIGS. 1-8 provides a means to control tip injection flows largely within the fan case liners by turning the drums 26.

Depending on system needs, the offset may be an extent of challenging distortion or the length it takes for stall to fully develop between areas. The drum 26 my turn to open from areas of higher pressure and treat areas forward of it with lower pressure or flow. Having the potential for channels 48 within the liner or casing traveling axially and circumferentially may be beneficial. If an area's aft portion has high pressure then its forward portion may also be high (even accounting for swirling flow). Therefore, there may also need to be circumferential relocation of the transfer flows.

What is claimed is:

1. A fan case assembly adapted for use with a gas turbine engine, the fan case assembly comprising a case that extends circumferentially at least partway about a central axis of the fan case assembly to define an outer boundary of a gas path of the gas turbine engine, the case formed to define a plurality of internal channels and a plurality of grooves that extend axially at least partway between an axially forward end of the fan case and an axially aft end of the fan case, the plurality of grooves intersecting the internal channels, a plurality of drums, each one of the plurality of drums disposed in a corresponding one of the plurality of grooves of the fan case and spaced circumferentially about the central axis, each drum of the plurality of drums shaped to include a passageway that extends through the corresponding drum, each drum of the plurality of drums configured to rotate about a respective drum axis between a closed position in which the passageway of the corresponding drum is positioned to block fluid communication between the passageway and at least one of the internal channels, and an open position in which the passageway of the corresponding drum is positioned to allow fluid communication between the gas path and the at least one internal channel through the passageway, and a control unit configured to rotate the plurality of drums about the respective drum axis between the closed position and the open position in response to preselected operating conditions to minimize negative effects pressure and swirl distortions in the gas turbine engine to improve stall margin.

2. The fan case assembly of claim 1, wherein each one of the plurality of internal channels extends axially and circumferentially though the case.

3. The fan case assembly of claim 2, wherein each one of the plurality of internal channels includes a first end and a second end, wherein the first end is spaced apart from the second end in the axial and circumferential direction.

4. The fan case assembly of claim 3, wherein the plurality of drums includes a first drum and a second drum spaced circumferentially apart from the first drum, wherein in the open position, the first end of the internal channel is in fluid communication with the passageway of a first drum and the second end of the internal channel is in fluid communication with the passageway of the second drum.

5. The fan case assembly of claim 4, wherein the passageway of the first drum is disposed axially forward of the passageway of the second drum.

6. The fan case assembly of claim 1, wherein each drum of the plurality of drums is shaped to form a forward passageway and an aft passageway disposed axially aft of the forward passageway.

7. The fan case assembly of claim 6, wherein each one of the plurality of internal channels extends between the forward passageway of a first one of the plurality of drums and the aft passageway of a second one of the plurality of drums.

8. The fan case assembly of claim 1, wherein when looking axially along the drum axis, a profile of the passageway is L shaped.

9. The fan case assembly of claim 8, wherein in the open position, a first portion of the L shaped passageway is aligned with one of the plurality of internal channels and a second portion of the L shaped passageway faces radially towards the gas path in fluid communication with the gas path.

10. The fan case assembly of claim 1, wherein the plurality of internal channels include a circumferential channel and an axial channel.

11. The fan case assembly of claim 10, wherein the plurality of drums includes a first drum and a second drum, the circumferential channel extending between the first drum and the second drum.

12. The fan case assembly of claim 11, wherein the plurality of drums includes a third drum, the second drum disposed circumferentially between the first drum and the third drum, wherein the axial channel extends axially and circumferentially between the second drum and the third drum.

13. The fan case assembly of claim 12, wherein when looking axially along the drum axis, a profile of the passageway of the second drum is T shaped.

14. The fan case assembly of claim 13, wherein the control unit is configured to rotate the first drum, the second drum, and the third drum independent of one another and position the first drum and the third drum in the open position and the second drum in a bypass position.

15. The fan case assembly of claim 14, wherein in the bypass position, a first portion of the T shaped passageway of the second drum is aligned with the circumferential channel and the internal channel to allow fluid communication between the passageway of the first drum, the circumferential channel, the passageway of the second drum, the internal channel, and the passageway of the third drum.

16. The fan case assembly of claim 15, wherein in the bypass position a second portion of the T shaped passageway faces radially away from the gas path to block fluid communication between the T shaped passageway of the second drum and the gas path.

17. A gas turbine engine comprising a fan including a fan rotor configured to rotate about an axis of the gas turbine engine and a plurality of fan blades coupled to the fan rotor for rotation therewith and a fan case assembly adapted for use with the gas turbine engine, the fan case assembly comprising a case that extends circumferentially at least partway about a central axis of the fan case assembly to define an outer boundary of a gas path of the gas turbine engine, the case formed to define a plurality of internal channels and a plurality of grooves that extend axially at least partway between an axially forward end of the fan case and an axially aft end of the fan case, the plurality of grooves intersecting the internal channels, a plurality of drums, each one of the plurality of drums disposed in a corresponding one of the plurality of grooves of the fan case and spaced circumferentially about the central axis, each drum of the plurality of drums shaped to include a passageway that extends through the corresponding drum, each drum of the plurality of drums configured to rotate about a respective drum axis between a closed position in which the passageway of the corresponding drum is positioned to block fluid communication between the passageway and at least one of the internal channels and an open position in which the passageway of the corresponding drum is positioned to allow fluid communication between the gas path and the at least one internal channel through the passageway, and a control unit configured to rotate the plurality of drums about the respective drum axis between the closed position and the open position in response to preselected operating conditions to minimize negative effects pressure and swirl distortions in the gas turbine engine to improve stall margin.

18. The gas turbine engine of claim 17, wherein each drum of the plurality of drums forms a forward passageway and an aft passageway disposed axially aft of the forward passageway.

19. The gas turbine engine of claim 18, wherein each one of the plurality of internal channels extends between the forward passageway of a first one of the plurality of drums and the aft passageway of a second one of the plurality of drums.

20. A method comprising providing a fan case assembly adapted for use with a gas turbine engine, the fan case assembly including a case that extends circumferentially at least partway about a central axis of the gas turbine engine and formed to define an outer boundary of a gas path of the gas turbine engine, the case formed to the case formed to define a plurality of internal channels and a plurality of drums arranged in axial grooves intersecting the internal channels, each drum of the plurality of drums shaped to include a passageway that extends through the corresponding drum, each drum of the plurality of drums configured to rotate about a respective drum axis, locating the plurality of drums in a closed position in which the passageway of the corresponding drum is positioned to block fluid communication between the passageway and at least one of the internal channels, and rotating the plurality of drums to an open position in which the passageway of the corresponding drum is positioned to allow fluid communication between the gas path and the at least one internal channel.

* * * * *